US010398944B2

(12) United States Patent
Berggren et al.

(10) Patent No.: US 10,398,944 B2
(45) Date of Patent: Sep. 3, 2019

(54) SPORT BALL WITH INDENTED CASING

(71) Applicant: NIKE, Inc., Beaverton, OR (US)

(72) Inventors: Scott R. Berggren, Portland, OR (US); Tal Cohen, Larchmont, NY (US); Vincent F. White, Beaverton, OR (US); Gary W. Glahn, Rhoddodendron, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/823,966

(22) Filed: Nov. 28, 2017

(65) Prior Publication Data

US 2018/0078827 A1 Mar. 22, 2018

Related U.S. Application Data

(60) Division of application No. 15/185,500, filed on Jun. 17, 2016, now Pat. No. 9,855,469, which is a continuation of application No. 14/145,215, filed on Dec. 31, 2013, now Pat. No. 9,370,693, which is a continuation-in-part of application No. 14/088,850, filed on Nov. 25, 2013, now Pat. No. 9,254,424, which is a division of application No. 12/959,886, filed on Dec. 3, 2010, now Pat. No. 8,617,011.

(51) Int. Cl.

| | |
|---|---|
| ***A63B 41/08*** | (2006.01) |
| ***A63B 45/00*** | (2006.01) |
| *A63B 102/18* | (2015.01) |

(52) U.S. Cl.

CPC ..... *A63B 41/08* (2013.01); *A63B 45/00* (2013.01); *A63B 2102/18* (2015.10); *A63B 2102/182* (2015.10); *A63B 2243/007* (2013.01); *A63B 2243/0025* (2013.01); *A63B 2243/0037* (2013.01); *A63B 2243/0066* (2013.01); *A63B 2243/0095* (2013.01)

(58) Field of Classification Search

CPC . A63B 41/08; A63B 45/00; A63B 2243/0025; A63B 2102/18; A63B 2243/0037; A63B 2243/0066; A63B 2243/0095

See application file for complete search history.

(56) References Cited

U.S. PATENT DOCUMENTS 3,256,019 A * 6/1966 Barton ..... A63B 37/0097 156/170

5,931,752 A 8/1999 Guenther et al.

(Continued)

*Primary Examiner* — Steven B Wong

(74) *Attorney, Agent, or Firm* — Quinn IP Law

(57) ABSTRACT

A sport ball includes a casing formed from a plurality of panels joined together at a plurality of seams. Each of the plurality of panels includes (a) a first layer having a first thickness, formed from a polymer material, and positioned to form a portion of an exterior surface of the sport ball; (b) a second layer having a second thickness, formed from a polymer foam material, and positioned inward and adjacent to the first layer; and (c) a third layer positioned inward and adjacent to the second layer. The first layer defines a first indentation therein. The first layer is bonded directly to the third layer at the first indentation, and the first indentation has a first indentation thickness equal to a sum of the first thickness and the second thickness. The sport ball also includes a bladder located within the casing.

19 Claims, 18 Drawing Sheets

(56) References Cited

U.S. PATENT DOCUMENTS

| | | | | |
|---|---|---|---|---|
| 6,206,795 | B1 * | 3/2001 | Ou | A63B 41/08 473/599 |
| 6,283,881 | B1 | 9/2001 | Feeney | |
| 6,406,389 | B1 * | 6/2002 | Feeney | A63B 41/08 473/596 |
| 6,506,135 | B2 * | 1/2003 | Ou | A63B 41/08 156/172 |
| 6,726,583 | B1 * | 4/2004 | Lai | A63B 41/10 473/599 |
| 2004/0087396 | A1 * | 5/2004 | Chan | A63B 41/00 473/605 |
| 2005/0277499 | A1 * | 12/2005 | Tang | A63B 41/085 473/604 |
| 2006/0046879 | A1 | 3/2006 | Kelly et al. | |
| 2008/0032834 | A1 * | 2/2008 | Krysiak | A63B 41/08 473/597 |
| 2009/0325742 | A1 * | 12/2009 | Krysiak | A63B 41/08 473/596 |
| 2018/0161635 | A1 * | 6/2018 | Ahmed | A63B 41/08 |

* cited by examiner

SPORT BALL WITH INDENTED CASING

CROSS-REFERENCE TO RELATED APPLICATIONS

This application is a divisional of U.S. patent application Ser. No. 15/185,500, filed on Jun. 17, 2016 and published on Oct. 6, 2016 as United States Patent Application Publication No. 2016/0287948, entitled "Sport Ball With Indented Casing", the entire disclosure of which is incorporated herein by reference. U.S. patent application Ser. No. 15/185,500 is a continuation of U.S. patent application Ser. No. 14/145,215, filed on Dec. 31, 2013 and issued on Jun. 21, 2016 as U.S. Pat. No. 9,370,693, entitled "Sport Ball With Indented Casing", the entire disclosure of which is incorporated herein by reference. U.S. patent application Ser. No. 14/145,215 is a continuation-in-part of U.S. patent application Ser. No. 14/088,850, filed on Nov. 25, 2013 and issued on Feb. 9, 2016 as U.S. Pat. No. 9,254,424, entitled "Sport Ball With Indented Casing", the entire disclosure of which is incorporated herein by reference. U.S. patent application Ser. No. 14/088,850 is a divisional of U.S. patent application Ser. No. 12/959,886, filed on Dec. 3, 2010 and issued on Dec. 31, 2013 as U.S. Pat. No. 8,617,011, entitled "Sport Ball With Indented Casing", the entire disclosure of which is incorporated herein by reference.

BACKGROUND

A variety of inflatable sport balls, such as a soccer ball, conventionally exhibit a layered structure that includes a casing, an intermediate structure, and a bladder. The casing forms an exterior portion of the sport ball and is generally formed from a plurality of durable and wear-resistant panels joined together along abutting edge areas (e.g., with stitching or adhesives). Although panel configurations may vary significantly, the casing of a traditional soccer ball includes thirty-two panels, twelve of which have a pentagonal shape and twenty of which have a hexagonal shape.

The intermediate structure forms a middle portion of the sport ball and is positioned between the casing and the bladder. Among other purposes, the intermediate structure may provide a softened feel to the sport ball, impart energy return, and restrict expansion of the bladder. In some configurations, the intermediate structure or portions of the intermediate structure may be bonded, joined, or otherwise incorporated into the casing as a backing material. In other configurations, the intermediate structure or portions of the intermediate structure may be bonded, joined, or otherwise incorporated into the bladder.

The bladder, which has an inflatable configuration, is located within the intermediate structure to provide an interior portion of the sport ball. In order to facilitate inflation (i.e., with pressurized air), the bladder generally includes a valved opening that extends through each of the intermediate structure and casing, thereby being accessible from an exterior of the sport ball.

It may be desirable to provide the exterior surface of a sport ball with grooves or indentations. It may also be desirable to provide such indentations in a predetermined pattern in order to provide increased performance and to facilitate manufacturing of the ball.

SUMMARY

A sport ball includes a casing formed from a plurality of panels joined together at a plurality of seams. Each of the plurality of panels includes (a) a first layer having a first thickness, formed from a polymer material, and positioned to form a portion of an exterior surface of the sport ball; (b) a second layer having a second thickness, formed from a polymer foam material, and positioned inward and adjacent to the first layer; and (c) a third layer positioned inward and adjacent to the second layer. The first layer defines a first indentation therein. The first layer is bonded directly to the third layer at the first indentation, and the first indentation has a first indentation thickness equal to a sum of the first thickness and the second thickness. The sport ball also includes a bladder located within the casing.

In one aspect, the third layer may have an interior surface facing toward an interior of the sport ball and the interior surface may have a substantially planar configuration opposite the first indentation.

The first indentation may have a first shoulder and a second shoulder each having a substantially rounded shape. In another embodiment, the first indentation may have a first shoulder and a second shoulder each having a substantially square configuration.

Further, the first indentation may extend across one of the plurality of seams. In another embodiment, the first indentation may be spaced apart from one of the plurality of seams.

In one embodiment, a sport ball includes a casing formed from a plurality of panels joined together at a plurality of seams. A first panel of the plurality of panels includes (a) a first layer having a first thickness, formed from a polymer material, and positioned to form a portion of an exterior surface of the sport ball; (b) a second layer having a second thickness, formed from a polymer foam material, and positioned inward and adjacent to the first layer; and (c) a third layer positioned inward and adjacent to the second layer. The first layer defines a first indentation therein, a second indentation therein spaced apart from the first indentation, and a third indentation therein spaced apart from the first indentation and the second indentation. The first layer is bonded directly to the third layer at the first indentation, the second indentation, and the third indentation. Each of the first indentation, the second indentation, and the third indentation has a first indentation thickness equal to a sum of the first thickness and the second thickness. Further, at least one of the first indentation, the second indentation, and the third indentation includes a first plurality of elongated portions arranged to demarcate a first simulated panel portion. In addition, a second panel of the plurality of panels includes (a) a fourth layer having a fourth thickness, formed from a polymer material, and positioned to form a portion of the exterior surface of the sport ball; (b) a fifth layer having a fifth thickness, formed from a polymer foam material, and positioned inward and adjacent to the fourth layer; and (c) a sixth layer positioned inward and adjacent to the fifth layer. The fourth layer defines a fourth indentation therein, a fifth indentation therein spaced apart from the fourth indentation, and a sixth indentation therein spaced apart from the fourth indentation and the fifth indentation. The fourth layer is bonded directly to the sixth layer at the fourth indentation, the fifth indentation, and the sixth indentation. Further, each of the fourth indentation, the fifth indentation, and the sixth indentation has a second indentation thickness equal to a sum of the fourth thickness and the fifth thickness. At least one of the fourth indentation, the fifth indentation, and the sixth indentation includes a second plurality of elongated portions arranged to demarcate a second simulated panel portion. The first simulated panel portion is spaced apart from the second simulated panel portion across the one of the plurality of seams. Further, the fourth indentation is configured to correspond with the first indentation across one of the plurality of seams to form a pattern across the one of the plurality of seams. The first simulated panel portion and the second simulated panel portion each have a polygonal shape. The sport ball also includes a bladder located within the casing.

In one embodiment, the first simulated panel portion and the second simulated panel portion may each have a pentagonal shape. In another embodiment, the first simulated panel portion and the second simulated panel portion may each have a hexagonal shape.

In another embodiment, the first indentation and the fourth indentation may extend across the one of the plurality of seams. The first indentation may have an elongate configuration and the fourth indentation may have the elongate configuration. The fourth indentation may extend in substantial alignment with the first indentation. Further, the first indentation and the fourth indentation may be arranged to form a pattern. The pattern may include one or more portions of a polygon.

In a further embodiment, the first indentation and the fourth indentation may be spaced apart from the one of the plurality of seams.

In one aspect, the first indentation may have a first shoulder and a second shoulder each having a substantially rounded shape. In another aspect, the first indentation may have a first shoulder and a second shoulder each having a substantially square configuration. In another aspect, the fourth indentation may have a first shoulder and a second shoulder each having a substantially rounded shape. In another aspect, the fourth indentation may have a first shoulder and a second shoulder each having a substantially square configuration.

The third layer may have an interior surface facing toward an interior of the sport ball and the interior surface may have a substantially planar configuration opposite the first indentation. The sixth layer may have an interior surface facing toward an interior of the sport ball and the interior surface may have a substantially planar configuration opposite the fourth indentation.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

BRIEF DESCRIPTION OF THE DRAWINGS

The invention can be better understood with reference to the following drawings and description. The drawings are schematic and, therefore, the components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
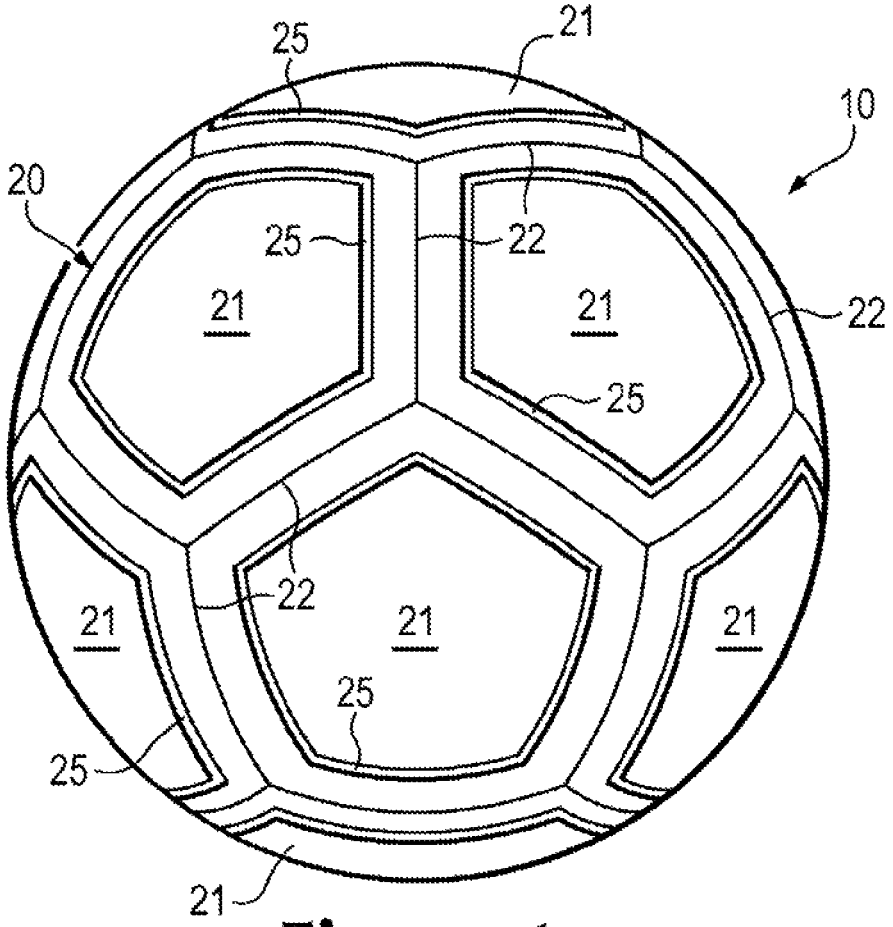
FIG. 1 is a perspective view of a sport ball.

The following discussion and accompanying figures disclose various sport ball configurations and methods relating to manufacturing of the sport balls. Although the sport ball is discussed and depicted in relation to a soccer ball, concepts associated with the configurations and methods may be applied to various types of inflatable sport balls. In addition to soccer balls, therefore, concepts discussed herein may be incorporated into basketballs, footballs (for either American football or rugby), volleyballs, and water polo balls, for example. A variety of non-inflatable sport balls, such as baseballs and softballs, may also incorporate concepts discussed herein. Accordingly, the concepts disclosed herein may apply to a wide variety of sport balls.

For purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, and/or other joining techniques. In addition, two components may be "fixedly attached" by virtue of being integrally formed, for example, in a molding process.

As utilized herein, the term "welding" or variants thereof (such as "thermal bonding") is defined as a technique for securing two elements to one another that involves a softening or melting of a polymer material within at least one of the elements such that the materials of the elements are secured to each other when cooled. Similarly, the term "weld" or variants thereof (e.g., "thermal bond") is defined as the bond, link, or structure that joins two elements through a process that involves a softening or melting of a polymer material within at least one of the elements such that the materials of the elements are secured to each other when cooled.

As examples, welding may involve (a) the melting or softening of two panels that include polymer materials such that the polymer materials from each panel intermingle with each other (e.g., diffuse across a boundary layer between the polymer materials) and are secured together when cooled and (b) the melting or softening a polymer material in a first panel such that the polymer material extends into or infiltrates the structure of a second panel (e.g., infiltrates crevices or cavities formed in the second panel or extends around or bonds with filaments or fibers in the second panel) to secure the panels together when cooled. Welding may occur when only one panel includes a polymer material or when both panels include polymer materials. Welding generally produces a heat affected zone in which the materials of the two joined components are intermingled. For purposes of this disclosure, this heat affected zone shall be considered a "weld" or "thermal bond."

Additionally, welding does not generally involve the use of stitching or adhesives, but involves directly bonding components to each other with heat. In some situations, however, stitching or adhesives may be utilized to supplement the joining of components through welding.

In some embodiments, sport ball casings may be formed of a plurality of panels. The panels may be joined to each other using welding to form the seams between the casing panels. As with traditional stitching of sport ball panels, the peripheral edges of the panels may be folded to form flange portions. The flange portions of adjacent panels may be welded to one another in a similar position as panels of a sewn ball casing. The majority of the seams may be formed by welding the panels to one another, forming the casing inside out. Once the majority of the seams are welded, the casing may be turned right side out through an opening between two or more panels that are not joined together. After the casing has been turned right side out, additional components may be inserted into the casing. For example a bladder configured to retain a pressurized gas may be inserted into the casing. In addition, an intermediate layer having a limited degree of stretch may be inserted between the bladder and the casing. General procedures for manufacturing a sport ball with welded seams may be performed as disclosed in Raynak et al., U.S. Patent Application Publication No. 2010/0240479, published on Sep. 23, 2010, and entitled "Sport Ball Casing and Methods of Making the Casing," the entire disclosure of which is incorporated herein by reference.

One advantage of utilizing a welding process to form the seams relates to the overall mass of the ball. Whereas approximately ten to fifteen percent of the mass of a conventional sport ball may be from the seams between panels, welding casing panels to one another to form the seams may reduce the mass by eliminating stitching and/or adhesives from the seam. The mass that would otherwise be imparted by the stitching and/or adhesives may be utilized for other structural elements that enhance the performance properties (e.g., energy return, sphericity, mass distribution, durability, aerodynamics) of the ball. Another advantage relates to manufacturing efficiency. Stitching each of the seams of a conventional sport ball may be a relatively time-consuming process, particularly when hand stitching is utilized. By welding panels together to form the seams between panels, the time necessary for forming the casing may be reduced, thereby increasing the overall manufacturing efficiency.

In some embodiments, sport ball casing panels may include a polymer material that may be utilized to secure the panels to each other. Examples of suitable polymer materials for the casing may include thermoplastic and/or thermoset polyurethane, polyamide, polyester, polypropylene, and polyolefin. In some configurations, the casing may incorporate filaments or fibers that reinforce or strengthen the casing. In further configurations, casing 20 may have a layered structure that includes an outer layer of the polymer material and an inner layer formed from a textile, polymer foam, or other material that is bonded with the polymer material.

When exposed to sufficient heat, the polymer materials within the casing panels transition from a solid state to either a softened state or a liquid state, particularly when a thermoplastic polymer material is utilized. When sufficiently cooled, the polymer materials then transition back from the softened state or the liquid state to the solid state. Based upon these properties of polymer materials, welding processes may be utilized to form a weld that joins peripheral portions of panels to each other.

General Sport Ball Configuration

Figure 2:
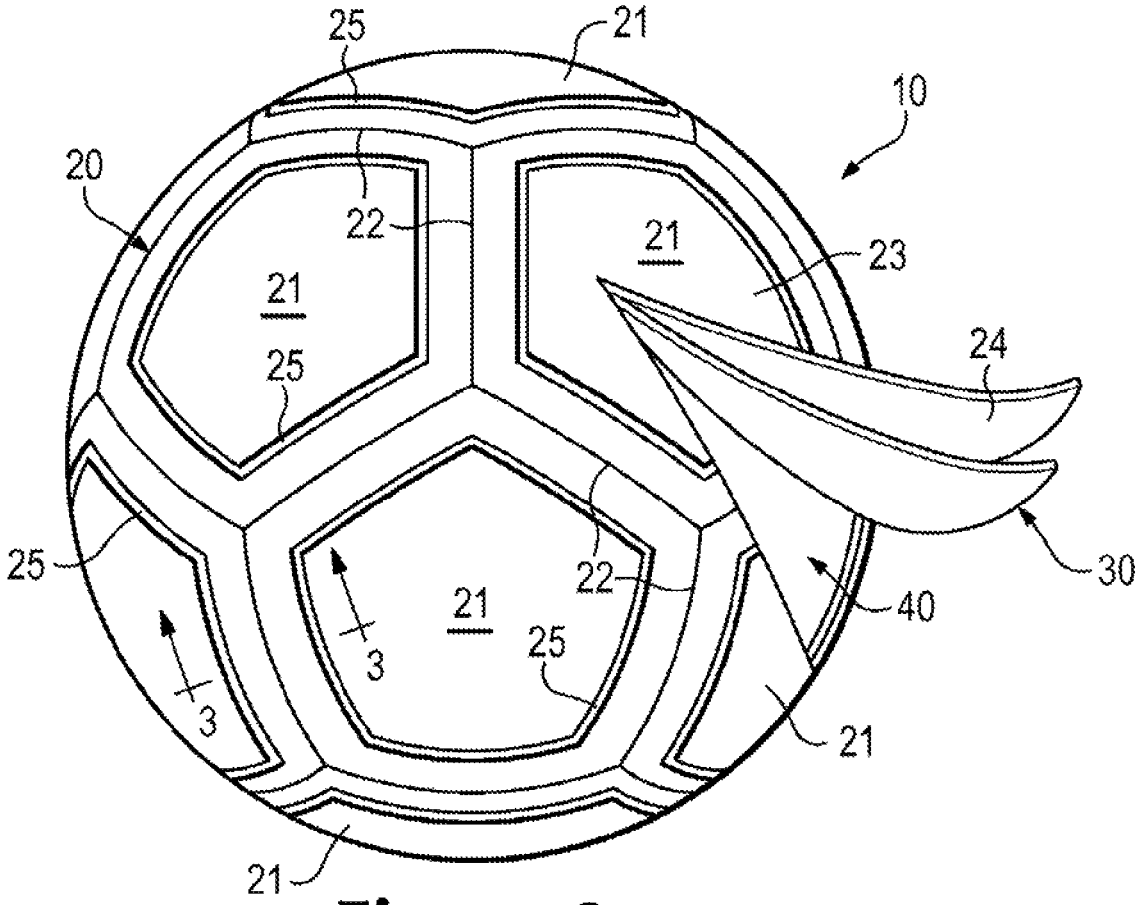
FIG. 2 is another perspective view of the sport ball.
Figure 3:
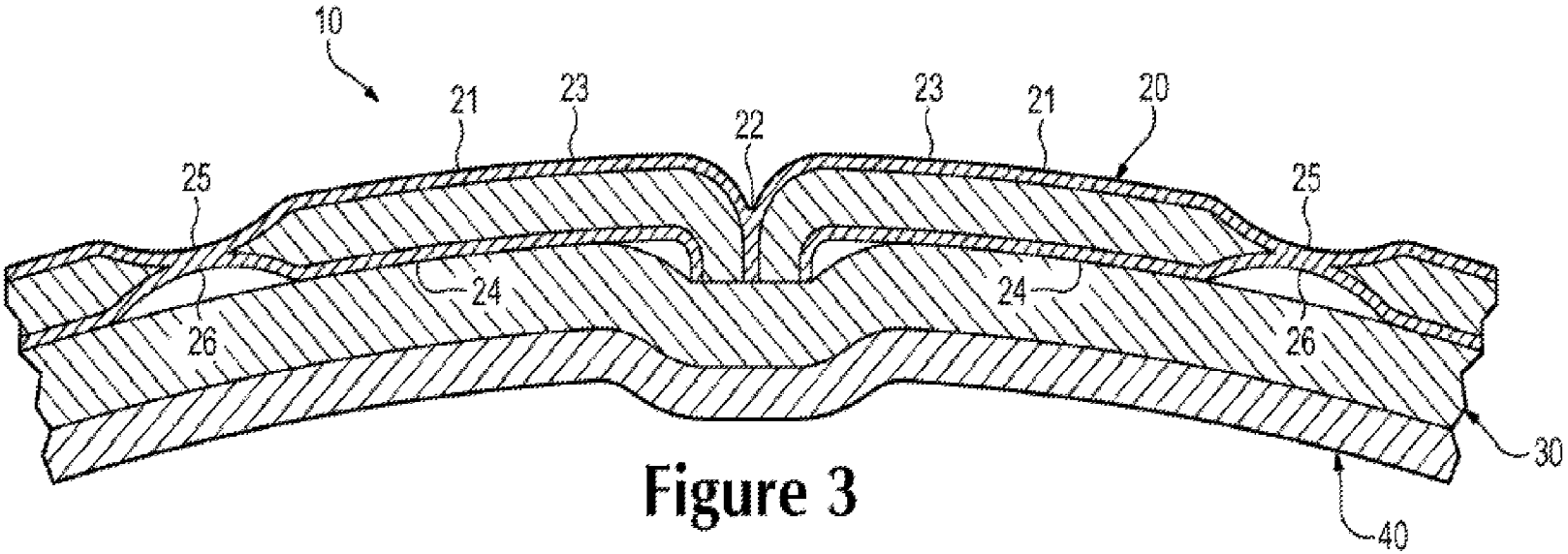
FIG. 3 is a cross-sectional view of the sport ball, as defined by section line 3 in FIG. 2.

A sport ball 10 having the general configuration of a soccer ball is depicted in FIGS. 1-3. Ball 10 exhibits a layered structure having (a) a casing 20 that forms an exterior portion of ball 10, (b) an intermediate structure 30 located within casing 20, and (c) an inflatable bladder 40 that forms an interior portion of ball 10. Upon pressurization, bladder 40 induces ball 10 to take on a substantially spherical shape. More particularly, pressure within bladder 40 causes bladder 40 to place an outward force upon intermediate structure 30. In turn, intermediate structure 30 places an outward force upon casing 20. In order to limit expansion of bladder 40 and also limit tension in casing 20, a portion of intermediate structure 30 may have a limited degree of stretch. In other words, bladder 40 places an outward force upon intermediate structure 30, but the stretch characteristics of intermediate structure 30 effectively prevent the outward force from inducing significant tension in casing 20. Accordingly, intermediate structure 30 restrains pressure from bladder 40, while permitting outward forces to induce a spherical shape in casing 20, thereby imparting a spherical shape to ball 10.

Casing 20 is formed from various panels 21 that are joined together along abutting side or edge areas to form a plurality of seams 22. Although panels 21 are depicted as having the shapes of twelve equilateral pentagons, panels 21 may have non-equilateral shapes, concave or convex edges, or a variety of other shapes (e.g., triangular, square, rectangular, hexagonal, trapezoidal, round, oval, non-geometrical) that combine in a tessellation-type manner to form casing 20. In some configurations, ball 10 may have twelve pentagonal panels 21 and twenty hexagonal panels 21 to impart the general configuration of a traditional soccer ball. Selected panels 21 may also be formed of unitary (i.e., one piece) construction with adjacent panels 21 to form bridged panels that reduce the number of seams 22. Although seams 22 may be formed by joining the abutting edge areas of panels 21 with stitching (e.g., hand or machine stitching), seams 22 may also be formed through adhesive bonding or welding. An example of welded seams is disclosed in U.S. Patent Application Publication 2010/0240479 to Raynak, et al., which is incorporated herein by reference.

Casing 20 defines an exterior surface 23 and an opposite interior surface 24. Exterior surface 23 faces outward and forms an exterior surface of ball 10. Interior surface 24 is located opposite exterior surface 23 and faces inward and toward intermediate structure 30. In many configurations of ball 10, interior surface 24 contacts intermediate structure 30. A plurality of indentations 25 and 26 are formed in casing 20 and extend toward a central area of casing 20, as depicted in FIGS. 1-3. Whereas indentations 25 are formed in exterior surface 23, indentations 26 are formed in interior surface 24. Indentations 25 are generally located opposite indentations 26. Indentations 25 and 26 impart various advantages to ball 10. For example, indentations 25 may have a design or appearance that enhances the aesthetics of ball 10. In some configurations, indentations 25 may also form indicia identifying the manufacturer of ball 10 or conveying information as to the features of ball 10. Additionally, indentations 25 may enhance the aerodynamics of ball 10 or provide an individual with greater control over ball 10 during kicking, dribbling, or passing, for example.

Intermediate structure 30 is positioned between casing 20 and bladder 40 and may be formed to include one or more of a compressible foam layer that provides a softened feel to the sport ball, a rubber layer that imparts energy return, and a restriction layer to restrict expansion of bladder 40. The overall structure of intermediate structure 30 may vary significantly. As an example, the restriction layer may be formed from (a) a thread, yarn, or filament that is repeatedly wound around bladder 40 in various directions to form a mesh that covers substantially all of bladder 40, (b) a plurality of generally flat or planar textile elements stitched together to form a structure that extends around bladder 40, or (c) a plurality of generally flat or planar textile strips that are impregnated with latex and placed in an overlapping configuration around bladder 40. As another example, intermediate structure 30 may be formed as a substantially seamless and curved (e.g., hemispherical or spherical) textile, as disclosed in U.S. Patent Application Publication 2009/0325746 to Raynak, et al., which is incorporated herein by reference. In some configurations of ball 10, intermediate structure 30 or portions of intermediate structure 30 may also be bonded, joined, or otherwise incorporated into bladder 40, or intermediate structure 30 may be absent from ball 10. Accordingly, the structure of intermediate structure 30 may vary significantly to include a variety of configurations and materials.

Bladder 40 has an inflatable configuration and is located within intermediate structure 30 to provide an inner portion of ball 10. When inflated, bladder 40 exhibits a rounded or generally spherical shape. In order to facilitate inflation, bladder 40 may include a valved opening (not depicted) that extends through intermediate structure 30 and casing 20, thereby being accessible from an exterior of ball 10, or bladder 40 may have a valveless structure that is semi-permanently inflated. Bladder 40 may be formed from a rubber or carbon latex material that substantially prevents air or other fluids within bladder 40 from diffusing to the exterior of ball 10. In addition to rubber and carbon latex, a variety of other elastomeric or otherwise stretchable materials may be utilized for bladder 40. Bladder 40 may also have a structure formed from a plurality of joined panels, as disclosed in U.S. Patent Application Publication 2009/0325745 to Rapaport, et al., which is incorporated herein by reference.

Panel Configuration

Figure 4:
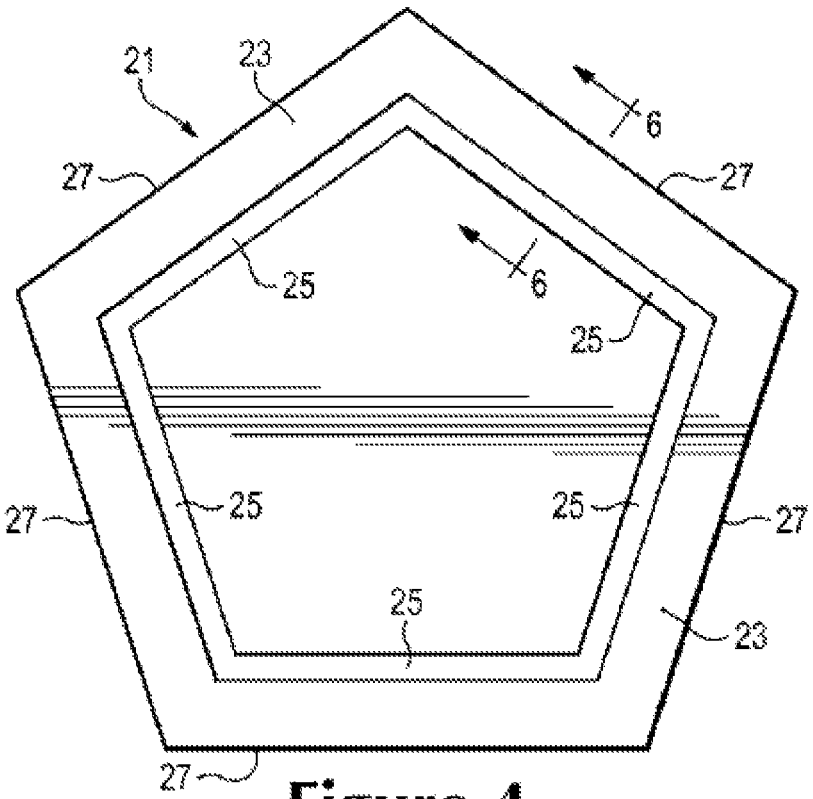
FIG. 4 is a top plan view of a panel of the sport ball.
Figure 5:
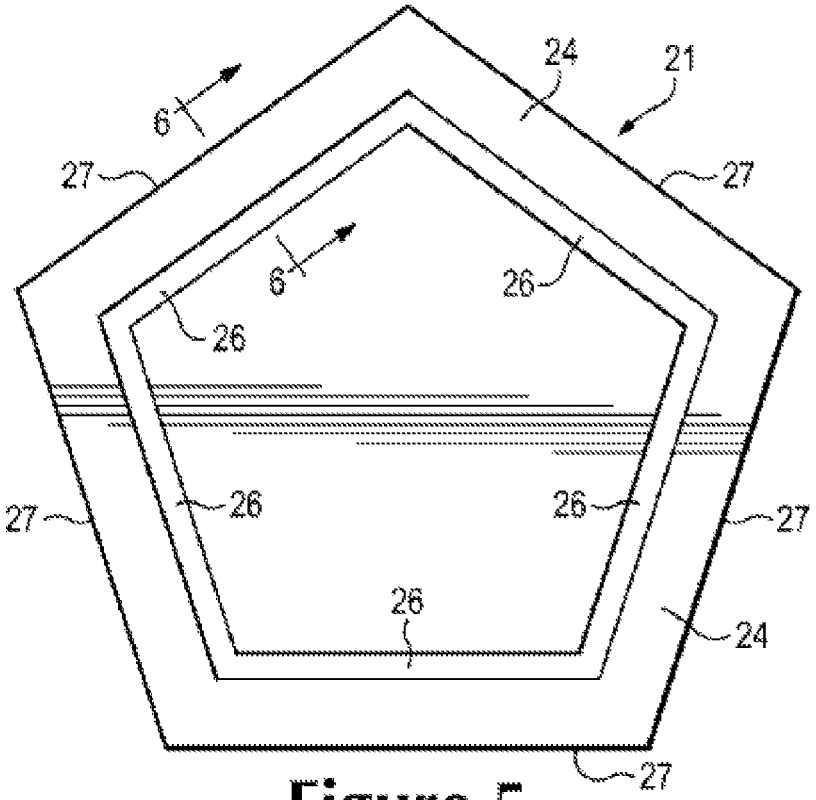
FIG. 5 is a bottom plan view of the panel.
Figure 6:
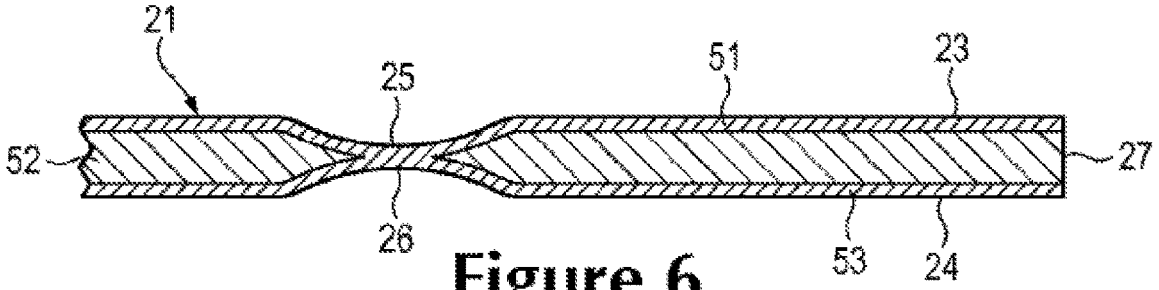
FIG. 6 is a cross-sectional view of the panel, as defined by section line 6 in FIGS. 4 and 5.

An individual panel 21 is depicted in FIGS. 4-6 and has a layered structure that includes a first or outer layer 51, a second or middle layer 52, and a third or inner layer 53. Outer layer 51 forms a portion of exterior surface 23, middle layer 52 is positioned inward and adjacent to outer layer 51, and inner layer 53 is positioned inward and adjacent to middle layer 52. In this configuration, middle layer 52 is positioned between layers 51 and 53. That is, layers 51 and 53 effectively form cover layers (i.e., outer and inner layers) located on opposite sides of middle layer 52.

A variety of materials may be utilized for each of layers 51-53, including various polymer materials, polymer foam materials, and textiles. More particularly, outer layer 51 may be formed from polymer materials that impart a durable and wear-resistant exterior surface for ball 10. Examples of suitable polymer materials for panels 21 include polyurethane, polyvinylchloride, polyamide, polyester, polypropylene, and polyolefin. In some configurations, outer layer 51 may be formed from a synthetic leather material. Middle layer 52 may be formed from a polymer foam material, such as polyurethane or ethylvinylacetate. In some configurations, middle layer 52 may include layers (e.g., three layers) of polymer foam material having different densities. Additionally, inner layer 53 may be formed from a textile material (e.g., a woven or knit textile). More particularly, the textile material of inner layer 53 may formed from polyester, cotton, nylon, rayon, silk, spandex, or a variety of other materials. The textile material may also include multiple materials, such as a polyester and cotton blend. In some configurations, one or more layers 51-53 may incorporate filaments or fibers that reinforce or strengthen casing 20.

Layers 51 and 53 are generally spaced from each other by middle layer 52. In the areas of indentations 25 and 26, however, layers 51 and 53 bow inward and are bonded or otherwise secured to each other. That is, indentations 25 and 26 are located opposite each other and extend into panel 21 at corresponding locations, where the portions of layers 51 and 53 that respectively form indentations 25 and 26 are secured to each other. In some embodiments, layers 51 and 53 may be thermal bonded to one another. Whereas a majority of outer layer 51 is spaced from inner layer 53, layers 51 and 53 extend through middle layer 52 in the areas of indentations 25 and 26 to bond or otherwise be secured to each other. As such, middle layer 52 may part, form an aperture, or otherwise be absent in the areas of indentations 25 and 26. In some configurations, middle layer 52 may compress significantly in the areas of indentations 25 and 26, thereby forming a polymer layer that separates the portions of layers 51 and 53 that form indentations 25 and 26.

Figure 7A:
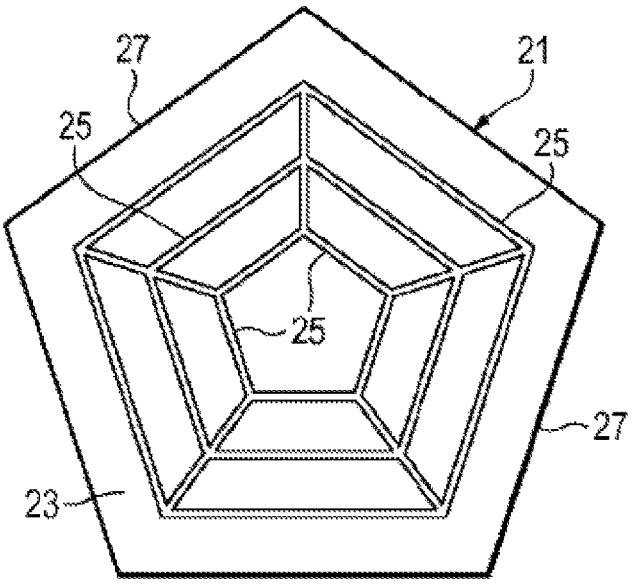
FIG. 7A is a top plan view corresponding with FIG. 4 and depicting a first configuration of the panel.
Figure 7B:
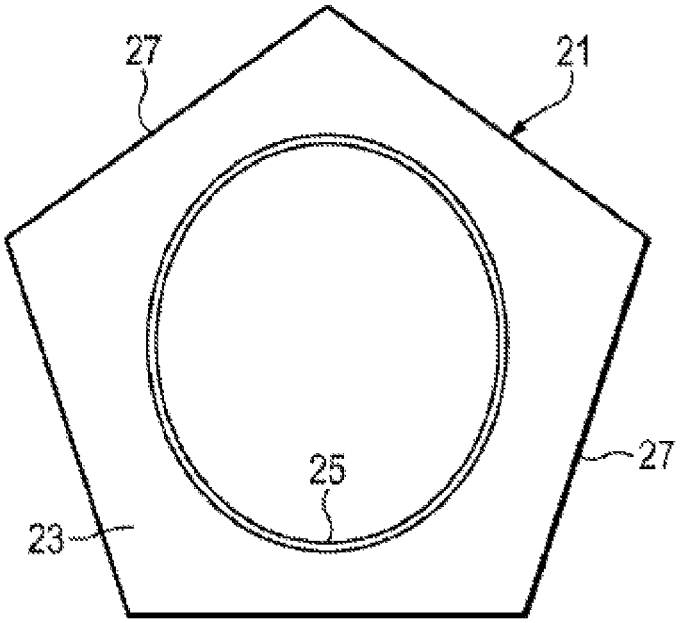
FIG. 7B is a top plan view corresponding with FIG. 4 and depicting a second configuration of the panel.
Figure 7C:
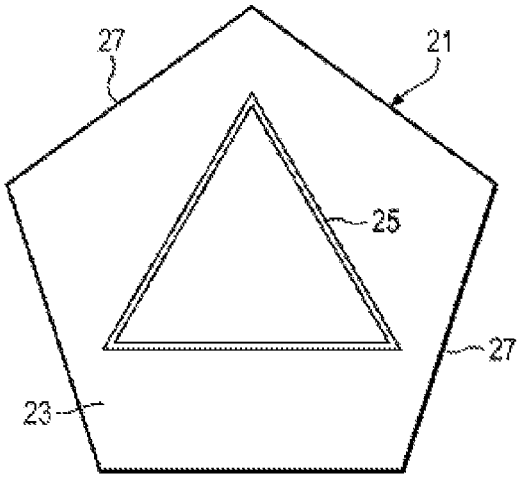
FIG. 7C is a top plan view corresponding with FIG. 4 and depicting a third configuration of the panel.
Figure 7D:
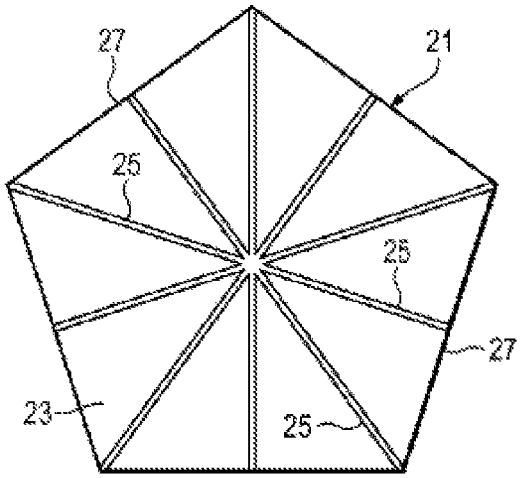
FIG. 7D is a top plan view corresponding with FIG. 4 and depicting a fourth configuration of the panel.
Figure 7E:
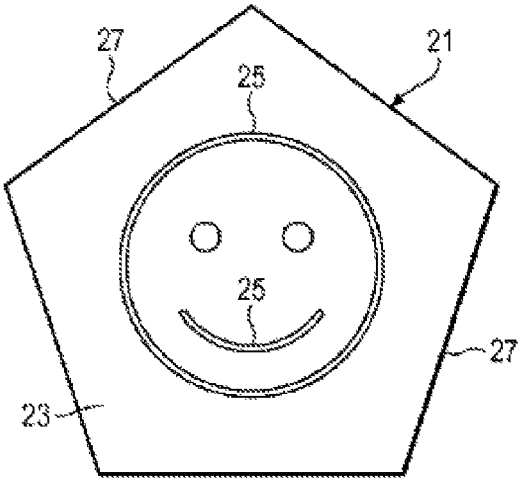
FIG. 7E is a top plan view corresponding with FIG. 4 and depicting a fifth configuration of the panel.
Figure 7F:
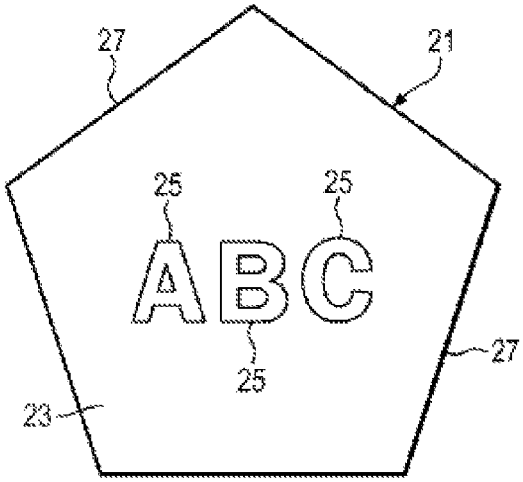
FIG. 7F is a top plan view corresponding with FIG. 4 and depicting a sixth configuration of the panel.

The positions of indentations 25 and 26 relative to panel 21 may vary considerably. As depicted, indentations 25 and 26 extend parallel to a plurality of edges 27 of panel 21. In this configuration, indentations 25 and 26 form a pentagonal shape that is spaced inward from edges 27. In further configurations of panel 21, however, indentations 25 and 26 may be located in other areas or may impart different shapes or arrangements. For example, FIG. 7A depicts a configuration wherein indentations 25 form concentric pentagons that are connected by radial portions. In FIGS. 7B and 7C, indentations 25 respectively have circular and triangular configurations, but may also be square, rectangular, hexagonal, or any other regular or non-regular shape. Referring to FIG. 7D, indentations 25 exhibit a radial configuration. In some configurations, indentations 25 may have a graphic appearance, as in FIG. 7E, or may impart information, as in FIG. 7F. Moreover, indentations 25 may also form the shape of a company logo or trademark. As discussed above, indentations 25 may have a design or appearance that enhances the aesthetics of ball 10, form indicia identifying the manufacturer of ball 10, convey information as to the features of ball 10, enhance the aerodynamics of ball 10, or provide an individual with greater control over ball 10. These advantages may be incorporated into ball 10 by varying the shapes and arrangements of indentations 25 and 26.

In some embodiments, the indentations may be spaced from the seams of the sport ball. This may facilitate manufacturing by providing substantially smooth surfaces at the peripheral edges of the panels that are joined to one another. In addition, spacing the indentations from the seams may provide performance benefits, such as aerodynamics and ball feel. FIGS. 7A-7C, 7E, and 7F illustrate configurations in which indentations 25 are spaced from seams 22. (See also, FIGS. 1-5.)

In some embodiments, the indentations may extend to edges of the panels. This may facilitate manufacturing, since multiple panels may be indented simultaneously, for example, by indenting a sheet of casing material, and then cutting the sheet into a plurality of panels. This may also enable patterns to be carried across multiple panels, bridging seams between the panels. FIG. 7D illustrates a configuration in which indentations 25 extend to peripheral edges of panel 21.

Figure 8A:
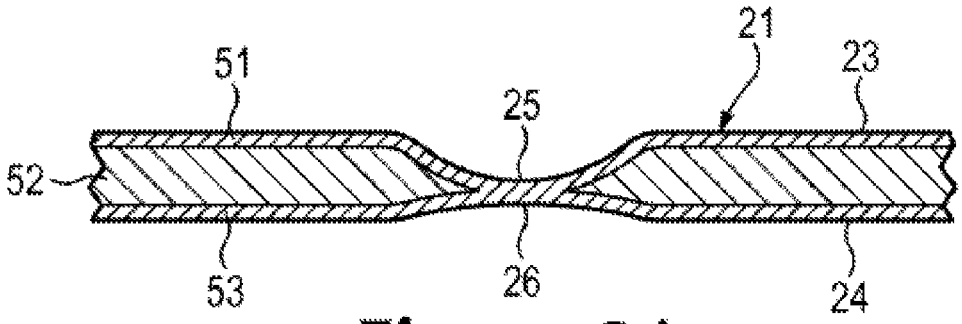
FIG. 8A is a cross-sectional view corresponding with FIG. 6 and depicting a seventh configuration of the panel.
Figure 8B:
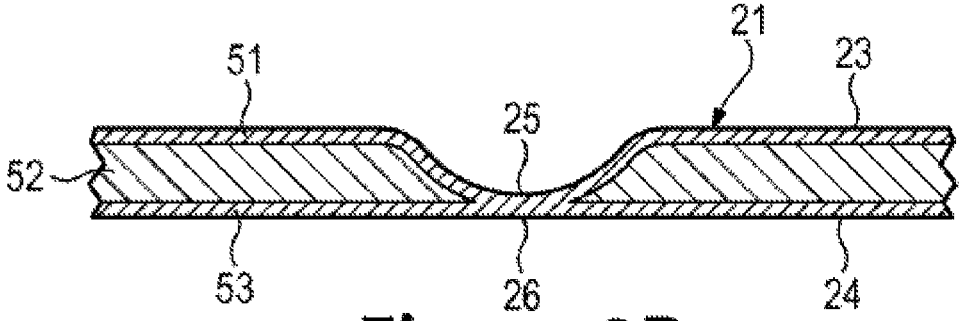
FIG. 8B is a cross-sectional view corresponding with FIG. 6 and depicting an eighth configuration of the panel.

The specific configuration of indentations 25 and 26 may also vary considerably. Referring to FIG. 6, indentations 25 and 26 each have a generally rounded configuration that extends to an approximate midpoint of panel 21. In another configuration, as depicted in FIG. 8A, indentations 25 may extend through more of the thickness of panel 21 than indentations 26. Referring to FIG. 8B, indentations 25 extend through substantially all of the thickness of panel 21. As also shown in FIG. 8B, in some embodiments, interior surface 24 of inner layer 53 may have a substantially planar configuration opposite indentation 25 in exterior surface 23 of panel 21.

Figure 8C:
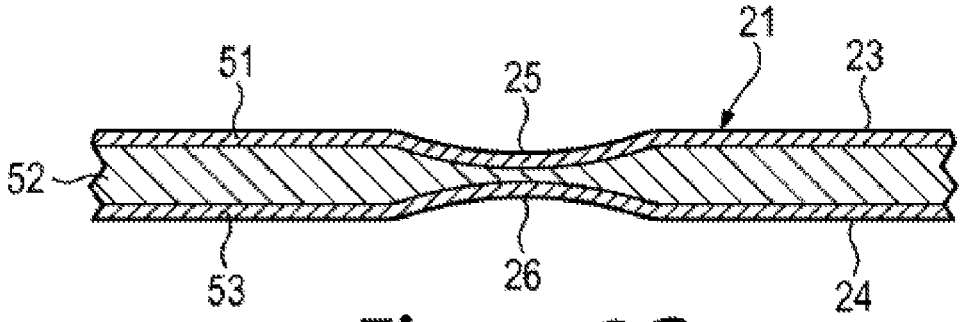
FIG. 8C is a cross-sectional view corresponding with FIG. 6 and depicting a ninth configuration of the panel.

Referring to FIG. 8C, indentations 25 and 26 may be spaced from each other such that a portion of middle layer 52 extends between indentations 25 and 26. In this configuration, middle layer 52 has (a) a first thickness between indentations 25 and 26 and (b) a second thickness in an area spaced from indentations 25 and 26, the first thickness being less than the second thickness.

As opposed to rounded, indentations 25 and 26 may also exhibit substantially squared configurations. For example, in some embodiments, the indentations may have substantially squared cross-sectional configurations. Such substantially squared cross-sectional configurations, may have a more distinct appearance than indentations having substantially rounded cross-sectional configurations. In addition, substantially squared indentations may also provide performance benefits such as aerodynamics, ball feel, and water channeling.

Figure 8D:
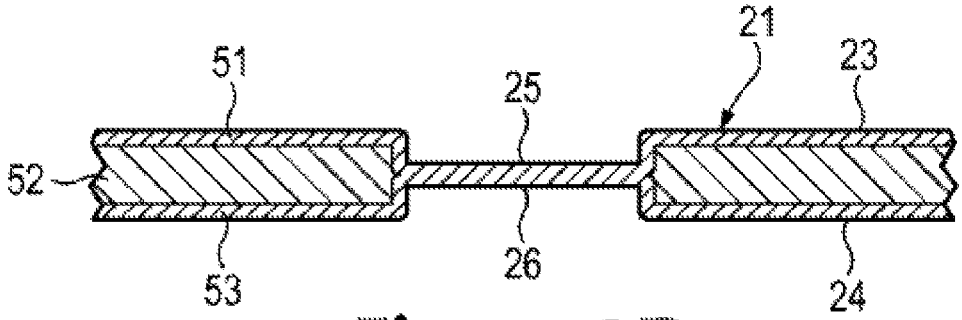
FIG. 8D is a cross-sectional view corresponding with FIG. 6 and depicting a tenth configuration of the panel.
Figure 8E:
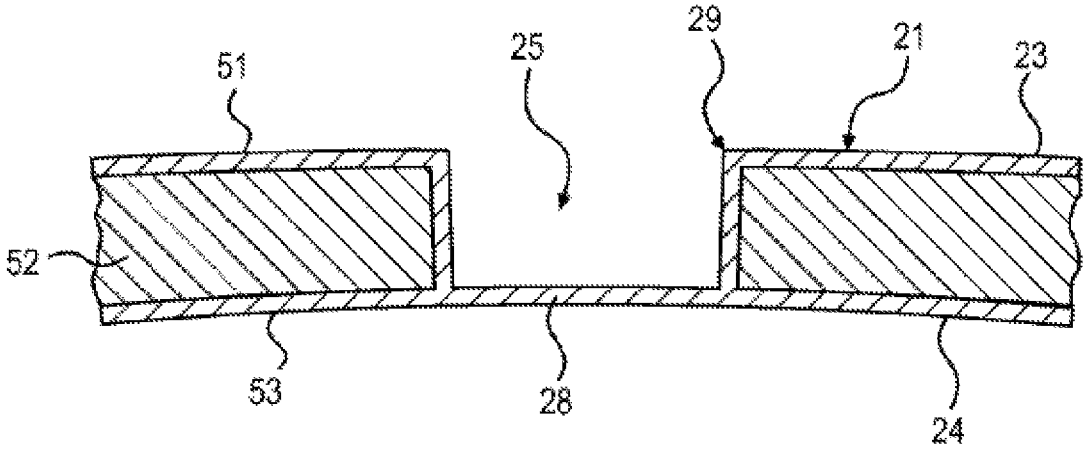
FIG. 8E is a cross-sectional view corresponding with FIG. 6 and depicting an eleventh configuration of the panel.

In some embodiments, panel 21 may include two opposing indentations having substantially squared cross-sectional configurations, as depicted in FIG. 8D. In some embodiments, panel 21 may include a substantially-squared indentation on only one side. For example, as shown in FIG. 8E, indentation 25 may extend through substantially all of a thickness of panel 21. Also, as further shown in FIG. 8E, interior surface 24 of inner layer 53 may have a substantially planar configuration opposite indentation 25 in exterior surface 23 of panel 21.

Figure 8F:
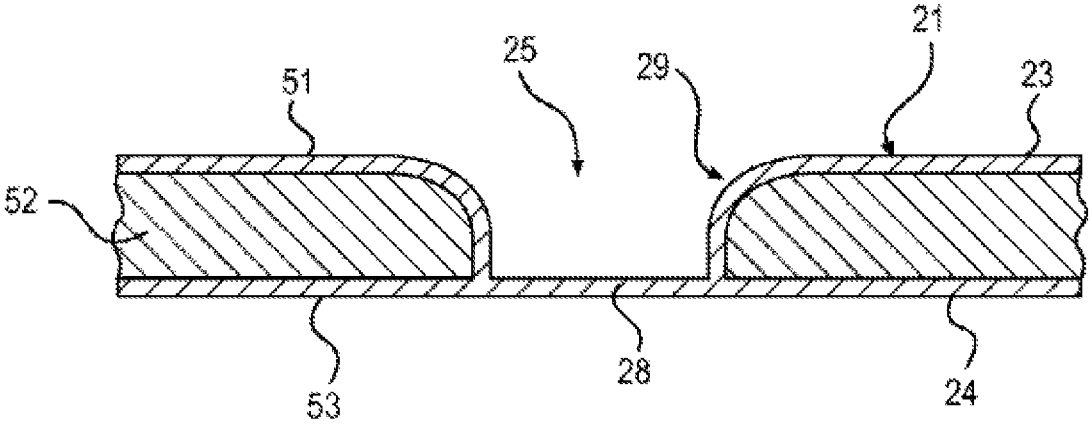
FIG. 8F is a cross-sectional view corresponding with FIG. 6 and depicting a twelfth configuration of the panel.

Accordingly, outer layer 51 may be bonded (e.g., thermal bonded) to inner layer 53 of the casing panel 21 in a bonded region 28. In some embodiments, a shoulder 29 of outer layer 51 may have a minimal radius, as shown in FIG. 8E. In other embodiments, a larger radius may be used at shoulder 29, as shown in FIG. 8F, in which indentation 25 also has a substantially squared cross-sectional configuration. The use of a minimal radius or a larger radius shoulder may be selected to facilitate manufacturing as well as for performance reasons, such as aerodynamics and ball feel.

Based upon the above discussion, panels 21 incorporate indentations 25 and 26, which may have a design or appearance that enhances the aesthetics of ball 10. In some configurations, indentations 25 may also form indicia identifying the manufacturer of ball 10 or conveying information as to the features of ball 10. Additionally, indentations 25 may enhance the aerodynamics of ball 10 or provide an individual with greater control over ball 10 during kicking, dribbling, or passing, for example.

Manufacturing Process

Figure 9A:
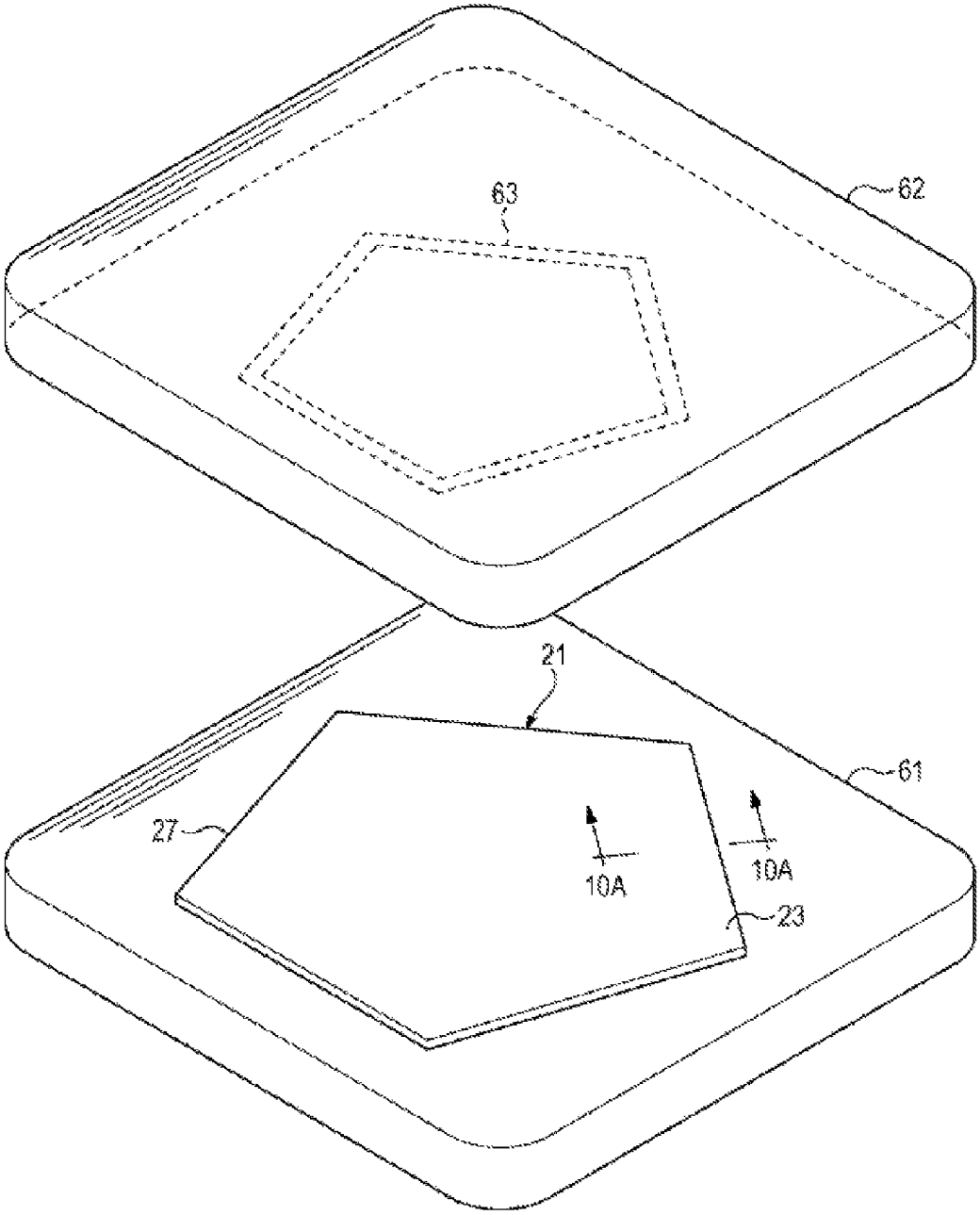
FIG. 9A is a schematic perspective view of a portion of a process for forming the panel.
Figure 9B:
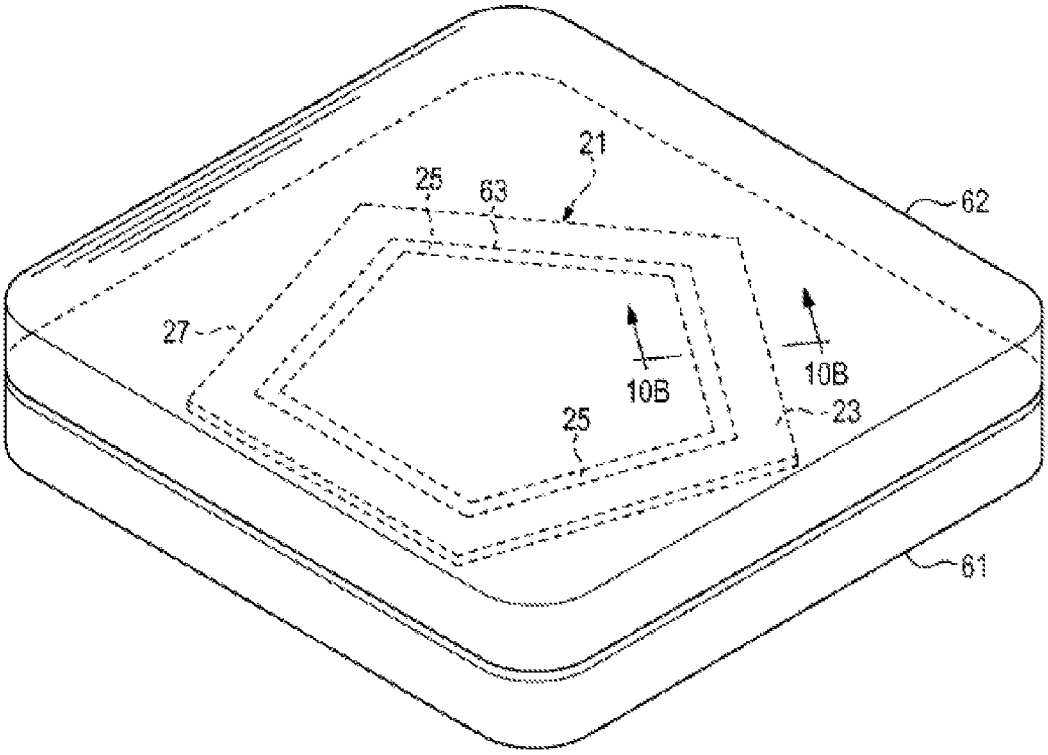
FIG. 9B is a schematic perspective view of another portion of the process for forming the panel.
Figure 9C:
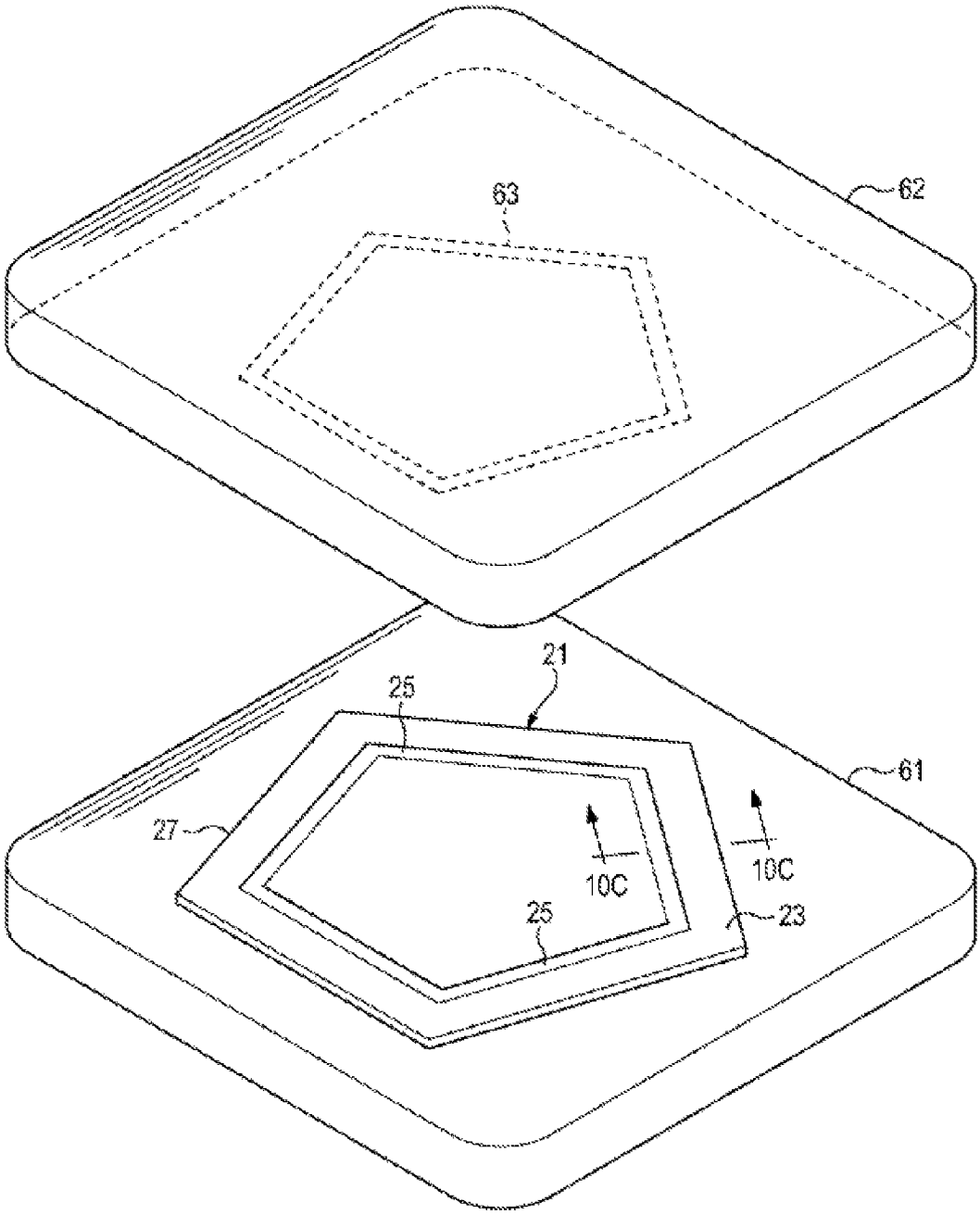
FIG. 9C is a schematic perspective view of a further portion of the process for forming the panel.
Figure 10A:
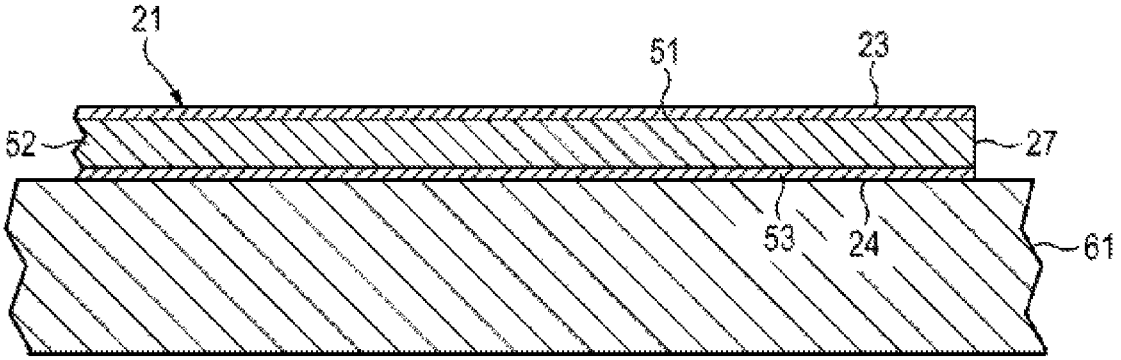
FIG. 10A is a cross-sectional view of the process for forming the panel, as respectively defined by section lines 10A in FIG. 9A.
Figure 10B:
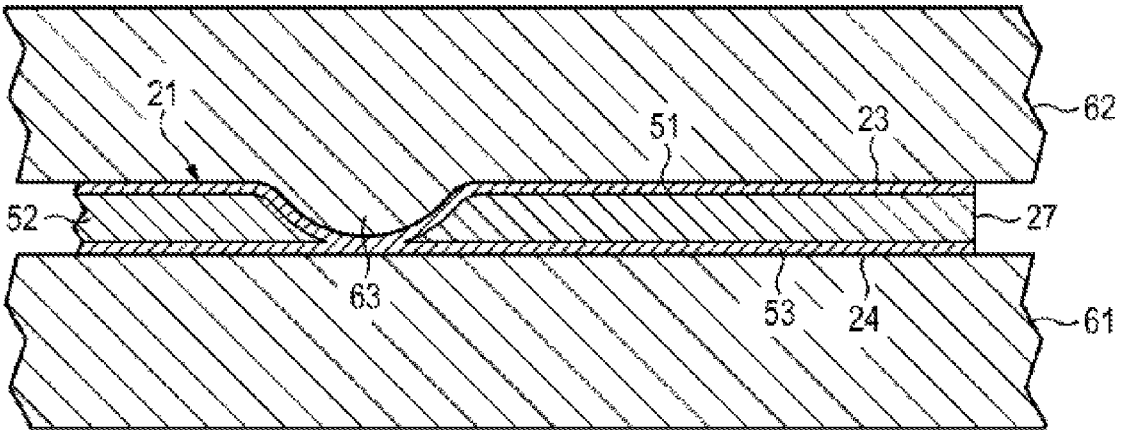
FIG. 10B is a cross-sectional view of the other portion of the process for forming the panel, as respectively defined by section lines 10B in FIG. 9B.
Figure 10C:
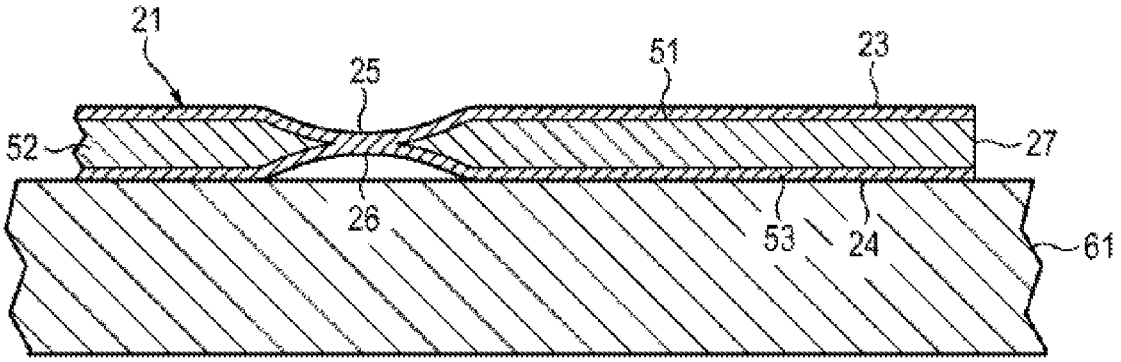
FIG. 10C is a cross-sectional view of the further portion of the process for forming the panel, as respectively defined by section lines 10C in FIG. 9C.

A variety of manufacturing processes may be utilized to form indentations 25 and 26 in panels 21. An example of a manufacturing process is depicted in FIGS. 9A-9C and 10A-10C. Referring to FIGS. 9A and 10A, one of panels 21 is located on a platen 61. A press plate 62 is positioned above platen 61 and includes a protrusion 63 having a pentagonal shape (e.g., a shape of indentations 25 and 26). Press plate 62 then translates toward platen 61 and compresses panel 21, as depicted in FIGS. 9B and 10B. More particularly, protrusion 63 presses into and heats the areas of panel 21 forming indentations 25 and 26. As such, press plate 62 and protrusion 63 (*a*) soften a portion of middle layer 52, which may be formed form a polymer foam material and (b) bond outer layer 51 to inner layer 53. As depicted in FIGS. 9C and 10C, press plate 62 then moves away from panel 21 to substantially complete the formation of indentations 25 and 26.

When exposed to sufficient heat, the polymer materials within panels 21 transition from a solid state to either a softened state or a liquid state, particularly when a thermoplastic polymer material is utilized. When sufficiently cooled, the polymer materials then transition back from the softened state or the liquid state to the solid state. Based upon these properties, (a) the polymer material of outer layer 51 may soften to form a bond with the textile material of inner layer 53 and (b) the polymer foam material of middle layer 52 may melt, soften, part, collapse, or form an aperture that permits layers 51 and 53 to contact and bond with each other.

In order to properly heat the materials within panel 21, bonding apparatus 62 may emit heat when in contact with panel 21. In some configurations, resistive heating elements may be incorporated into press plate 62 to raise the temperature of panel 21 in the areas of indentations 25 and 26. Alternately, high-frequency (HF) heating, radio frequency (RF) heating, or ultrasonic heating elements may be incorporated into press plate 62 and protrusion 63 to raise the temperature of panel 21 in the areas of indentations 25 and 26.

As an additional matter, the process disclosed above depicts protrusion 63 as pressing into one side of panel 21. That is, protrusion 63 presses into the side of panel 21 that includes outer layer 51. Although press plate 62 compresses outer layer 51 against inner layer 53, which lies against platen 61, indentation 26 forms in inner layer 53. More particularly, outer layer 51 is effectively placed in tension by the pressure from press plate 62. When the pressure from press plate 62 is removed, the tension in outer layer 51 pulls inner layer 53 toward the center of panel 21. Although protrusion 63 only presses into one side of panel 21, both indentations 25 and 26 are formed due to an equalization of forces in panel 21. Accordingly, both of indentations 25 and 26 may be formed by pressing into only one side of panel 21 with press plate 62.

Further Sport Ball Configurations

Figure 11:
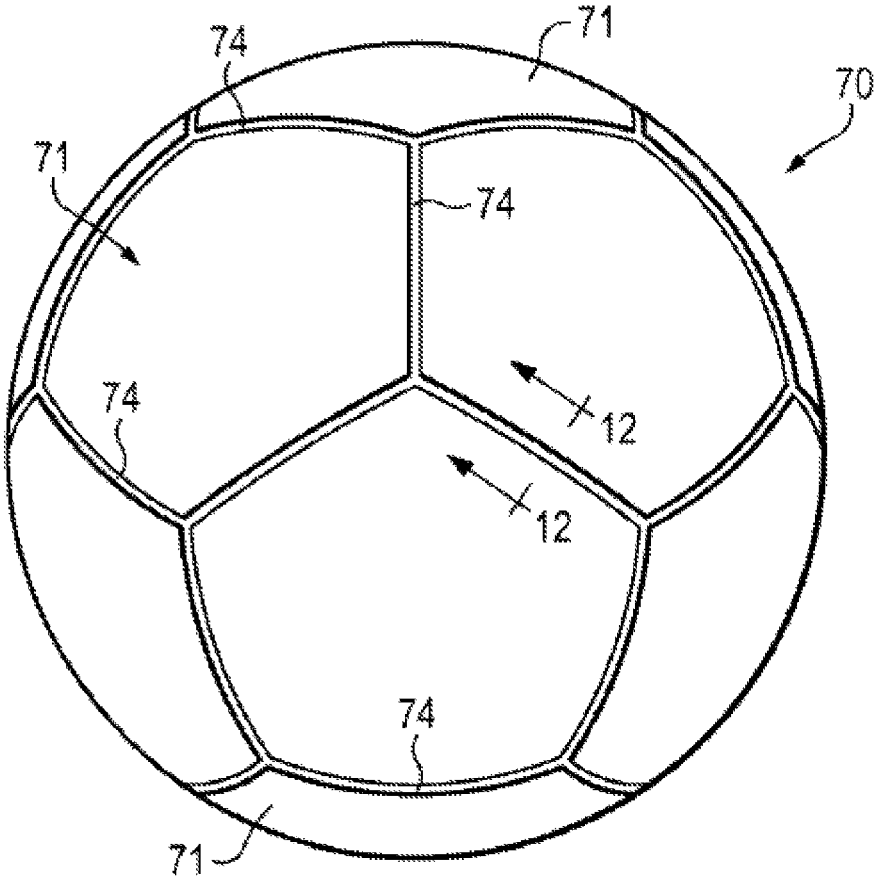
FIG. 11 is a perspective view of another sport ball.
Figure 12:
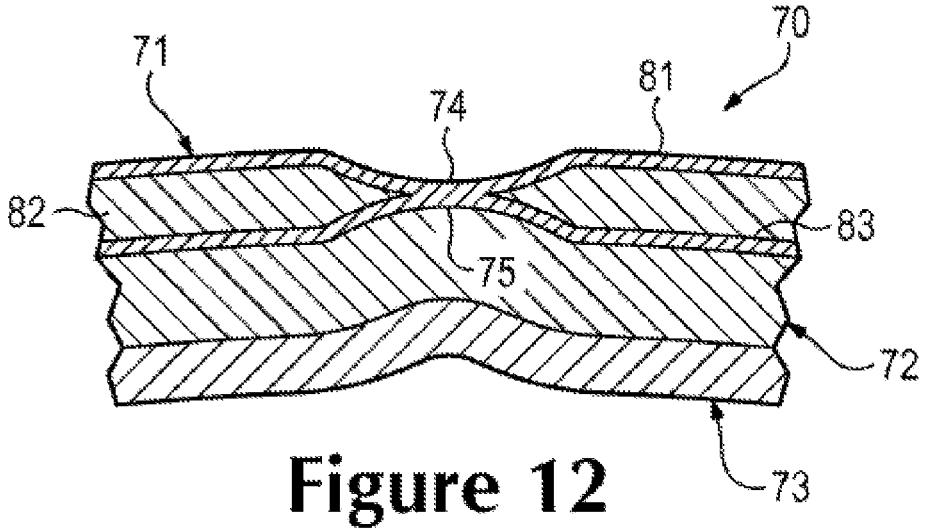
FIG. 12 is a cross-sectional view, as defined by section line 12 in FIG. 11.

Another sport ball 70 is depicted in FIGS. 11 and 12 as including a casing 71, an intermediate structure 72, and a bladder 73. As with panels 21 of casing 20, casing 71 has a layered configuration that includes an outer layer 81, a middle layer 82, and an inner layer 83. Additionally, layers 81 and 83 respectively form indentations 74 and 75 in areas of casing 71. Whereas casing 20 included various panels 21 that were joined by seams 22, casing 71 has a substantially uniform or unbroken configuration that does not include panels or includes fewer panels. In order to impart the appearance of seams similar to seams 22, however, indentations 74 and 75 are located in areas that correspond with the positions of seams 22 in ball 10. That is, indentations 74 and 75 impart the appearance of seams in ball 70.

In some embodiments, indentations in adjacent panels may be arranged to correspond with one another across the seams between the adjacent panels. In some embodiments, the indentations may extend proximate the seam on adjacent panels. In some cases, the indentations may extend to the edge of the panel, and thus continue across the seam. In some embodiments, the indentations of adjacent panels may be arranged to form a pattern, such as polygonal shapes. Further, the indentations may be arranged to continue a pattern of the seams between panels. For example, in some embodiments, the indentations may be aligned with seams. In some cases such indentations may be configured to define simulated panels of the casing. That is, by having the appearance of seams, indentations in the casing may be arranged to define portions of a panel that have the appearance of an entire panel. Further, in some embodiments, the indentations may be arranged in the pattern of a logo.

Figure 13:
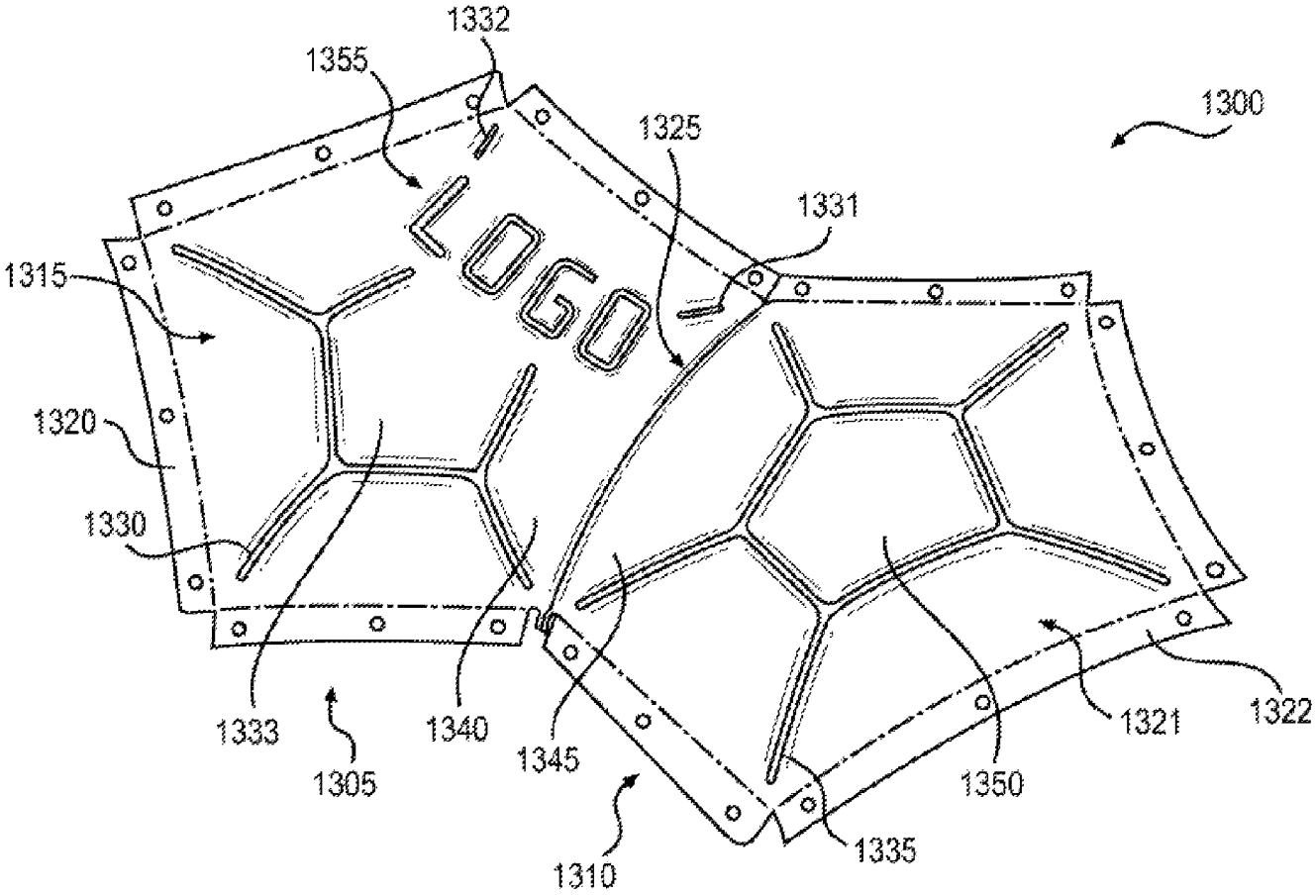
FIG. 13 is a schematic illustration of a portion of a casing, including two joined panels having indentations that form a pattern across the seam between the two panels.

FIG. 13 shows a portion of a sport ball casing 1300. Casing 1300 may be formed of a plurality of panels, including a first panel 1305 and a second panel 1310. First panel 1305 may be joined to second panel 1310 at a seam 1325. Seam 1325 may be formed using any suitable method of joining first panel 1305 and second panel 1310. Exemplary such methods include stitching, use of adhesives, and welding.

As shown in FIG. 13, first panel 1305 may include a first central panel portion 1315 and first flange areas 1320 at the peripheral edges of first panel 1305. Similarly, second panel may include a second central panel portion 1321 and second flange areas 1322. The flange areas may be joined to flange areas of other panels to form casing 1300 by forming seams, such as seam 1325.

First panel 1305 may include a first indentation 1330, a second indentation 1331, and a third indentation 1332. In some embodiments, first panel 1305 may include indentations arranged to form a logo 1355. Portions of first indentation 1330 may have an elongate configuration and may extend proximate to seam 1325. In some embodiments, first indentation 1330 may define a pattern that simulates seams of casing 1300. For example, in some cases, first indentation 1330 may include a plurality of elongate portions arranged to demarcate a first central simulated panel portion 1333, which may resemble a panel of casing 1300.

Second panel 1310 may include a fourth indentation 1335. Portions of fourth indentation 1335 may have an elongate configuration and may extend proximate to seam 1325. In addition, fourth indention 1335 may define a second central simulated panel portion 1350. First central simulated panel portion 1333 and second central simulated panel portion 1350 may have any suitable configurations. For example, as shown in FIG. 13, the central simulated panel portions may have a polygonal shape, such as a pentagonal shape, resembling a soccer ball panel.

In some embodiments, fourth indentation 1335 may be configured to correspond with first indentation 1330 and second indentation 1325 across seam 1325. Accordingly, first panel 1305 may also include a first mating panel portion 1340 defined by first indentation 1330 and second indentation 1331. Second panel 1310 may include a second mating panel portion 1345 defined by fourth indentation 1335. When first panel 1305 is joined to second panel 1310 at seam 1325, first mating panel portion 1340 may mate with second mating panel portion 1345 to form a pattern across seam 1325. For example, as shown in FIG. 13, first mating panel portion 1340 and second mating panel portion 1345 may combine to form a hexagonal casing portion that has the appearance of a hexagonal casing panel. In some embodiments, seam 1325 may include an indentation. In other embodiments, the exterior surface of casing 1300 may be substantially smooth across seam 1325.

In some embodiments, one or more of the indentations may continue a pattern formed by the plurality of seams joining panels of the casing. For example, as shown in FIG. 13, second indentation 1331 may be arranged in alignment with the edge of second panel 1310 and, therefore, may continue the pattern of a seam formed between second panel 1310 and an adjacent panel (not shown).

Figure 14:
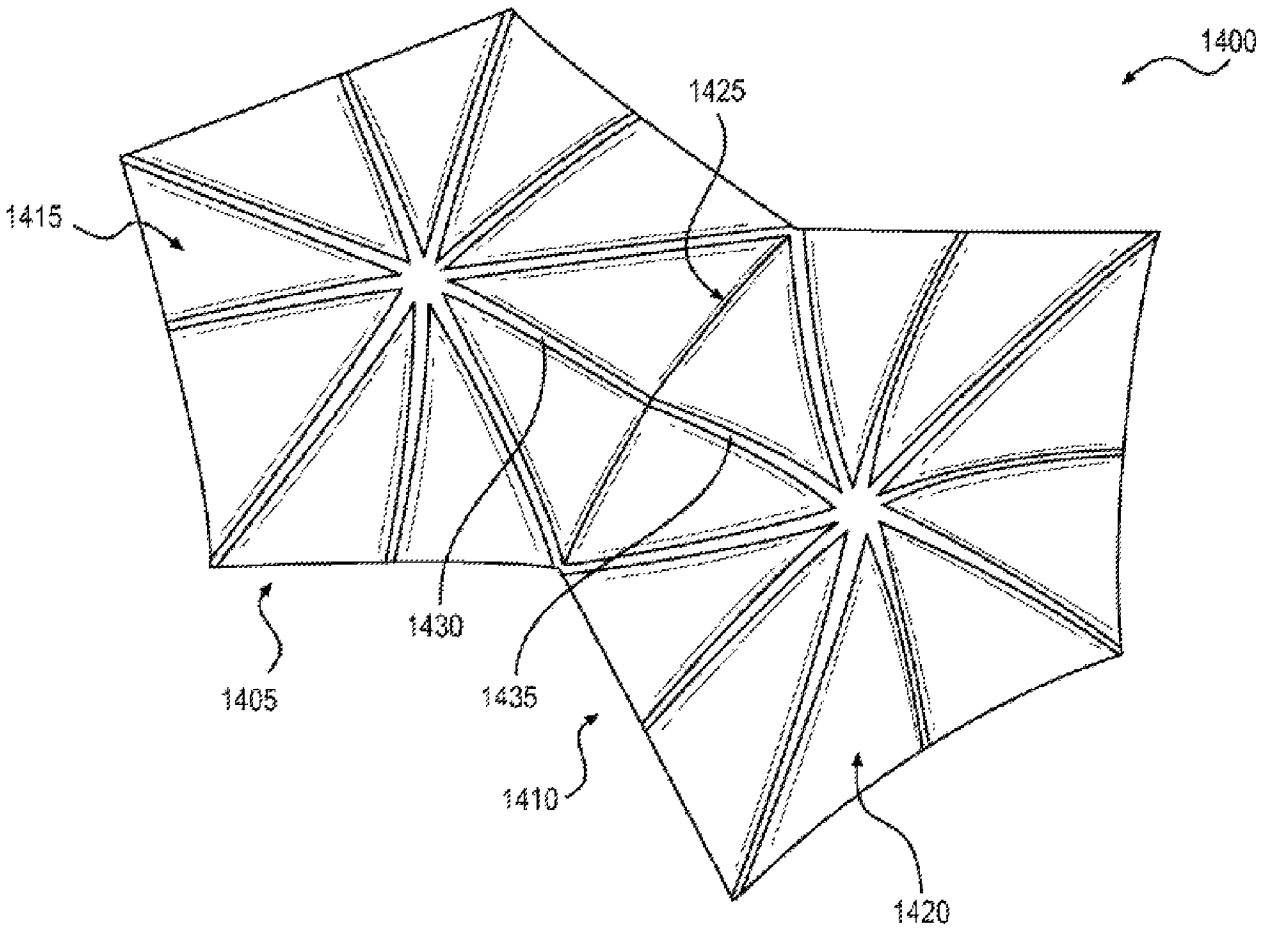
FIG. 14 is a schematic illustration of a portion of a casing, including two joined panels having indentations having the configuration shown in FIG. 7D.

FIG. 14 shows portions of a casing 1400, including a first panel 1405 and a second panel 1410, which may be joined to first panel 1405 at a seam 1425. First panel may include a first exterior surface 1415 and second panel 1410 may include a second exterior surface 1420. First panel 1405 and second panel 1410 may include indentations in first exterior surface 1415 and second exterior surface 1420, in which the indentations are arranged in the pattern shown in FIG. 7D. As shown in FIG. 14, first panel 1405 may include a first indentation 1430, and second panel 1410 may include a second indentation 1435. The indentations of first panel 1405 and second panel 1410 may have any of the configurations described above with respect to other disclosed embodiments.

In some embodiments, first indentation 1430 and second indentation 1435 may be arranged to form a pattern extending across seam 1425. For example, as shown in FIG. 14, in some embodiments, first indentation 1430 and second indentation 1435 may each have an elongate configuration. As further shown in FIG. 14, first indentation 1430 and second indentation 1435 may be in substantial alignment with one another across seam 1425.

While various embodiments of the invention have been described, the description is intended to be exemplary, rather than limiting and it will be apparent to those of ordinary skill in the art that many more embodiments and implementations are possible that are within the scope of the invention.

Although many possible combinations of features are shown in the accompanying figures and discussed in this detailed description, many other combinations of the disclosed features are possible. Therefore, it will be understood that any of the features shown and/or discussed in the present disclosure may be implemented together in any suitable combination. Accordingly, the invention is not to be restricted except in light of the attached claims and their equivalents. Also, various modifications and changes may be made within the scope of the attached claims.

The invention claimed is:

1. A sport ball comprising:

a casing formed from a plurality of panels joined together at a plurality of seams;

wherein each of the plurality of panels includes:

(a) a first layer having a first thickness, formed from a polymer material, and positioned to form a portion of an exterior surface of the sport ball;

(b) a second layer having a second thickness, formed from a polymer foam material, and positioned inward and adjacent to the first layer; and (c) a third layer positioned inward and adjacent to the second layer;

wherein the first layer defines a first indentation therein;

wherein the first layer is bonded directly to the third layer at the first indentation;

wherein the first indentation has a first indentation thickness equal to a sum of the first thickness and the second thickness;

a bladder located within the casing; and an intermediate layer disposed between the casing and the bladder;

wherein the third layer has an interior surface facing toward an interior of the sport ball and the interior surface has a substantially planar configuration directly opposite the first indentation such that the interior surface forms a bottom of the first indentation and the third layer contacts the intermediate layer.

2. The sport ball of claim 1, wherein the first indentation has a first shoulder and a second shoulder each having a substantially rounded shape.

3. The sport ball of claim 1, wherein the first indentation has a first shoulder and a second shoulder each having a substantially square configuration.

4. The sport ball of claim 1, wherein the first indentation extends across one of the plurality of seams.

5. The sport ball of claim 1, wherein the first indentation is spaced apart from one of the plurality of seams.

6. A sport ball comprising:

a casing formed from a plurality of panels joined together at a plurality of seams;

wherein a first panel of the plurality of panels includes:

(a) a first layer having a first thickness, formed from a polymer material, and positioned to form a portion of an exterior surface of the sport ball;

(b) a second layer having a second thickness, formed from a polymer foam material, and positioned inward and adjacent to the first layer; and (c) a third layer positioned inward and adjacent to the second layer;

wherein the first layer defines a first indentation therein, a second indentation therein spaced apart from the first indentation, and a third indentation therein spaced apart from the first indentation and the second indentation;

wherein the first layer is bonded directly to the third layer at the first indentation, the second indentation, and the third indentation;

wherein each of the first indentation, the second indentation, and the third indentation has a first indentation thickness equal to a sum of the first thickness and the second thickness;

wherein at least one of the first indentation, the second indentation, and the third indentation includes a first plurality of elongated portions arranged to demarcate a first simulated panel portion;

wherein a second panel of the plurality of panels includes:

(a) a fourth layer having a fourth thickness, formed from a polymer material, and positioned to form a portion of the exterior surface of the sport ball;

(b) a fifth layer having a fifth thickness, formed from a polymer foam material, and positioned inward and adjacent to the fourth layer; and (c) a sixth layer positioned inward and adjacent to the fifth layer;

wherein the fourth layer defines a fourth indentation therein, a fifth indentation therein spaced apart from the fourth indentation, and a sixth indentation therein spaced apart from the fourth indentation and the fifth indentation;

wherein the fourth layer is bonded directly to the sixth layer at the fourth indentation, the fifth indentation, and the sixth indentation;

wherein each of the fourth indentation, the fifth indentation, and the sixth indentation has a second indentation thickness equal to a sum of the fourth thickness and the fifth thickness;

wherein at least one of the fourth indentation, the fifth indentation, and the sixth indentation includes a second plurality of elongated portions arranged to demarcate a second simulated panel portion;

wherein the first simulated panel portion is spaced apart from the second simulated panel portion across one of the plurality of seams;

wherein the fourth indentation is configured to correspond with the first indentation across one of the plurality of seams to form a pattern across the one of the plurality of seams; and a bladder located within the casing;

wherein the first simulated panel portion and the second simulated panel portion each have a polygonal shape.

7. The sport ball of claim 6, wherein the first simulated panel portion and the second simulated panel portion each have a pentagonal shape.

8. The sport ball of claim 6, wherein the first simulated panel portion and the second simulated panel portion each have a hexagonal shape.

9. The sport ball of claim 6, wherein the first indentation and the fourth indentation extend across the one of the plurality of seams.

10. The sport ball of claim 9, wherein the first indentation has an elongate configuration and the fourth indentation has the same elongate configuration; and wherein the fourth indentation extends in substantial alignment with the first indentation.

11. The sport ball of claim 9, wherein the first indentation has an elongate configuration and the fourth indentation has the same elongate configuration; and wherein the first indentation and the fourth indentation are arranged to form a pattern.

12. The sport ball of claim 11, wherein the pattern includes one or more portions of a polygon.

13. The sport ball of claim 6, wherein the first indentation and the fourth indentation are spaced apart from one of the plurality of seams.

14. The sport ball of claim 6, wherein the first indentation has a first shoulder and a second shoulder each having a substantially rounded shape.

15. The sport ball of claim 6, wherein the first indentation has a first shoulder and a second shoulder each having a substantially square configuration.

16. The sport ball of claim 6, wherein the fourth indentation has a first shoulder and a second shoulder each having a substantially rounded shape.

17. The sport ball of claim 6, wherein the fourth indentation has a first shoulder and a second shoulder each having a substantially square configuration.

18. The sport ball of claim 6, wherein the third layer has an interior surface facing toward an interior of the sport ball and the interior surface has a substantially planar configuration opposite the first indentation.

19. The sport ball of claim 6, wherein the sixth layer has an interior surface facing toward an interior of the sport ball and the interior surface has a substantially planar configuration opposite the fourth indentation.

* * * * *